United States Patent [19]

Smith

[11] 3,983,768

[45] Oct. 5, 1976

[54] AUTOMATIC ADJUSTABLE WRENCH

[76] Inventor: Carl N. Smith, 17119 Blairwood, Houston, Tex. 77049

[22] Filed: May 15, 1975

[21] Appl. No.: 577,681

[52] U.S. Cl. ..... 81/130 R; 81/DIG. 6

[51] Int. Cl.[2] ..... B25B 13/12

[58] Field of Search ..... 81/129, 130 R, 146, 81/DIG. 6

[56] References Cited

UNITED STATES PATENTS

| | | | |
|---|---|---|---|
| 1,539,987 | 6/1925 | Bell | 81/130 R |
| 1,697,291 | 1/1929 | Spence | 81/130 R |
| 3,198,041 | 8/1965 | Davis | 81/129 |

*Primary Examiner*—Al Lawrence Smith
*Assistant Examiner*—James G. Smith
*Attorney, Agent, or Firm*—Carl B. Fox, Jr.

[57] ABSTRACT

Automatic adjustable wrench wherein one jaw is adjustable by movement of a toothed surface of the jaw along a toothed support. The movable jaw is spring biased to close against an object disposed between the jaws of the wrench, and hence is automatically adjusted.

6 Claims, 4 Drawing Figures

AUTOMATIC ADJUSTABLE WRENCH

BACKGROUND OF THE INVENTION

In the use of wrenches it is troublesome and time consuming to adjust the size of the jaw opening of the wrench to different sizes of bolt heads, nuts, or other objects to be engaged by the wrench. When work is done which requires frequent adjustment of the wrench jaw gap, much time may be wasted, and further, a bolt head or nut may be damaged by faulty wrench adjustment. This invention provides a wrench which is automatically adjustable to properly fit whatever is engaged by the wrench, within the limitations of the extent of adjustment of the wrench.

SUMMARY OF THE INVENTION

The invention provides an automatic adjustable wrench in which the jaws are opened by thumb or finger pressure against a control rod or button. When the jaws have been placed to opposite sides of the object to be engaged by the wrench, release of the control rod permits the movable jaw to close against the object under spring pressure. The angular back of the movable jaw has a tooth formation which engages in multiple positions along an angular tooth support of the wrench. The two tooth formations are spring biased apart for movement of the movable jaw during adjustment. All that is required to grasp an object with the wrench is depression of the control rod or button to open the wrench, placement of the wrench about the object to be grasped, and release of the control button to close the wrench. Upon rotation of the wrench to turn or twist the bolt head, nut, or other object engaged by the wrench, the tooth formations engage and the movable jaw is held firmly against movement during use of the wrench. When the wrench is not in use, the movable jaw automatically assumes its closed or minimum jaw opening position whereby the wrench requires a minimum of space during storage.

A principal object of the invention is to provide an automatic adjustable wrench. Another object of the invention is to provide such a wrench wherein a movable jaw is provided which has an angular toothed back surface which engages a similarly toothed support surface of the wrench. Still another object of the invention is to provide such a wrench wherein the adjustable jaw is spring biased to close, and wherein the adjustable jaw is spring biased to release its inclined tooth formation from the inclined support tooth formation. Another object of the invention is to provide such a wrench which may be used with a minimum of effort, and which is economical and dependable.

Other objects and advantages of the invention will appear from the following detailed description of a preferred embodiment, reference being made to the accompanying drawings.

BRIEF DESCRIPTIONS OF THE DRAWINGS

DESCRIPTION OF THE PREFERRED EMBODIMENT

Figure 1:
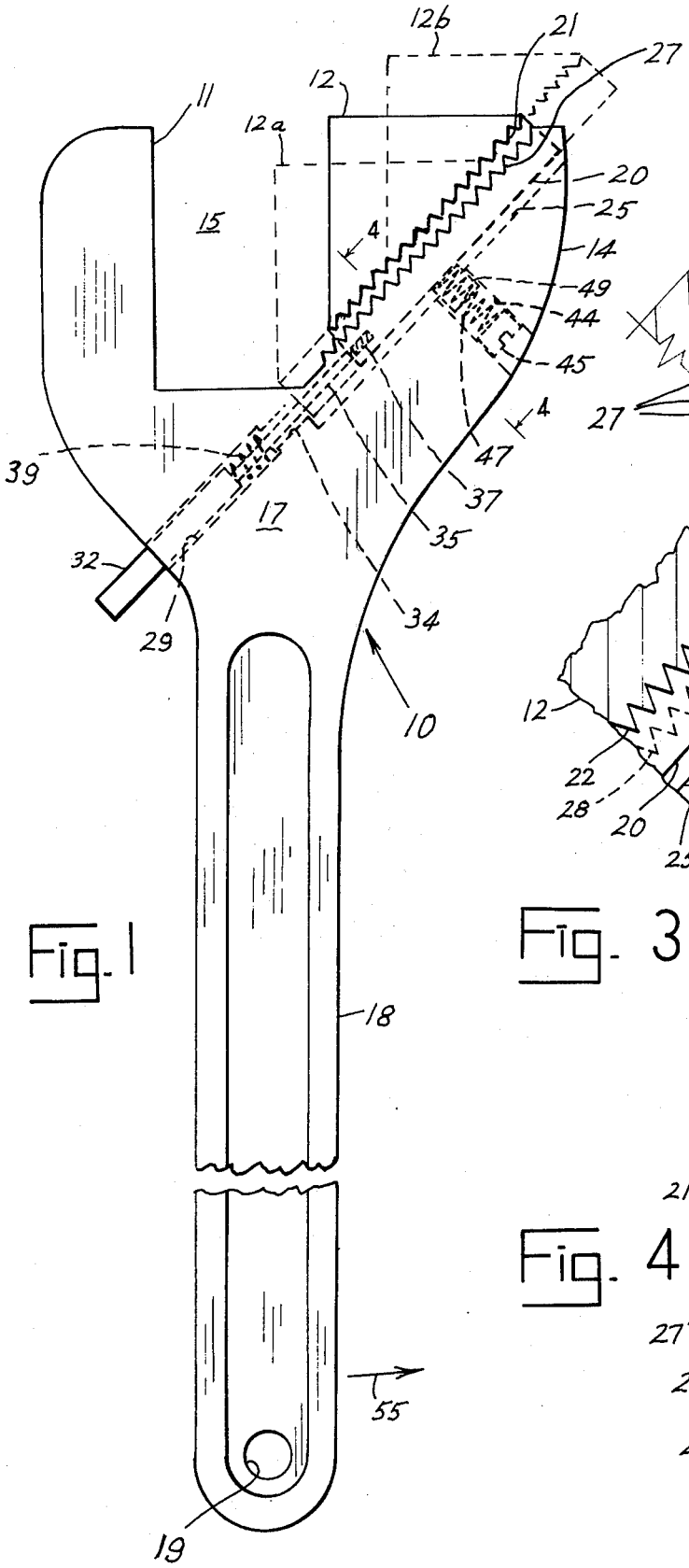
FIG. 1 is a side elevation of a wrench of preferred form according to the invention.

Referring now to the drawings in detail, the automatic adjustable wrench 10 has a fixed jaw 11 and a movable or adjustable jaw 12. A support 14 is provided across jaw opening 15 from fixed jaw 11, jaw 11 and support 14 being joined at the central base or body portion 17 of the wrench. A handle 18 for grasping by the hand is provided and is of customary form. A hole 19 is provided for hanging of the wrench when not in use.

Movable jaw 12 is of generally triangular form as shown in FIG. 1. At its angular, or hypotenuse, side, jaw 12 has a central angular sided flange 20 at opposite sides of which are provided tooth formations 21, 22. The angular side of support 14, adjacent movable jaw 12, has a longitudinal angle sided recess 35 to opposite sides of which are proided tooth formations 27, 28. Tooth formations 21, 22, 27, 28 have the same size teeth so that teeth 21 may engage with teeth 27 and so that teeth 22 may engage with teeth 28.

The body or base portion 17 of the wrench has a passage or bore 29 therethrough from beneath fixed jaw 11, disposed angularly to the end of recess 25. A control button 32 in the form of a rod is disposed within bore 29. Bore 29 is reduced at 34. Rod 32 is reduced at its portion 35. The end of reduced rod portion 35 is threaded and is screwed into a tapped opening in the end of flange 20 at 37. A helical compression spring 39 is disposed around the reduced portion of rod 32 with one end engaged with the larger portion of rod 32 and the other end engaged against the lefthand end of reduced bore portion 34. Rod 32, therefore, is biased outwardly of bore 29, and flange 20 and adjustable jaw 12 are biased to the closed position 12*a*. When rod 32 is pushed farther into bore 29, movable jaw 12 is moved to any intermediate position between its position 12*a* and its fully extended position 12*b*.

To enable tooth formations 21, 27 and 22, 28 to move with respect to one another, support 14 has an angular bore 44 therethrough which is tapped and has a threaded plug 45 adjustably screwed thereinto. A helical compression spring 47 within bore 44 has one end disposed against plug 45 and its opposite end disposed within a cup 49 which bears against the angular lower side of flange 20 of movable jaw 12. Spring 47 maintains the two sets of teeth 21, 27 and 22, 28 in spaced unengaged positions except when pressure is exerted against movable jaw 12 to overcome the force of spring 47 and bring the teeth together. The compressive force of spring 47 may be adjusted by rotation of plug 45, a slot 52 being provided in plug 45 for rotation by a screwdriver, or the like. Rod 32 opposes the force applied by spring 47, and the pressure of spring 47 should be only enough to keep the teeth separated for proper movement of jaw 12 for adjustment.

Figure 2:
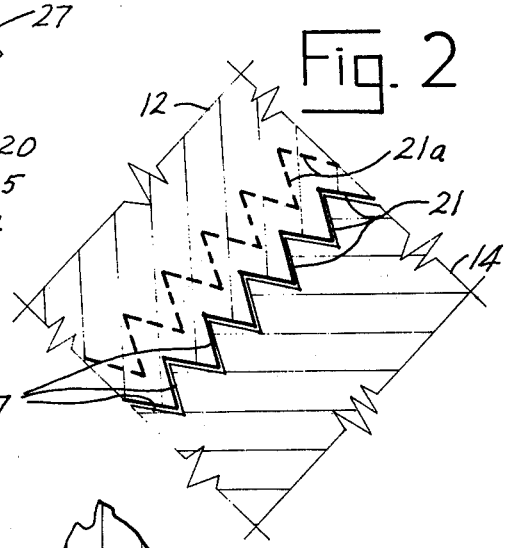
FIG. 2 is an enlarged partial cross section taken longitudinally of the movable jaw and support.
Figure 3:
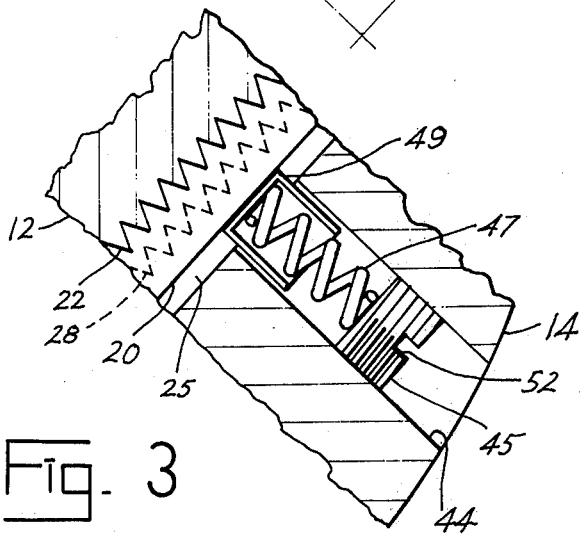
FIG. 3 is an enlarged partial cross section showing the means for maintaining the adjustable jaw and support separated for adjustment.
Figure 4:
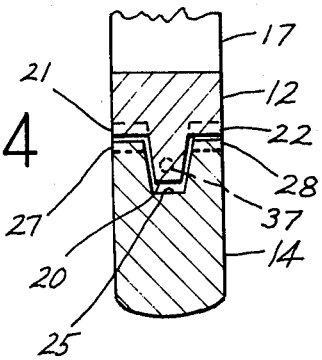
FIG. 4 is an angular cross section taken at line 4-4 of FIG. 1.

In FIG. 2, teeth 21 are shown engaged with teeth 27, as when jaw 12 is forced against support 14 by an object engaged by the wrench. When the pressure of the object is relieved, the teeth 21 move to position 21*a*, out of engagement with teeth 27. Teeth 22, 28 engage and disengage in the same manner.

The movable jaw 12 will be in its position 12a when the wrench is not in use. To open the wrench, that is to separate the jaws 11, 12 farther apart, the control button or rod 32 is pressed further into bore 29, this moving flange 20 and movable jaw 12 to a more open position such as position 12 or position 12*b*. The degree of opening of the movable jaw need be only sufficient to clear the object to be engaged by the wrench. This opening of the movable jaw compresses spring 39. When the jaws have been placed about the object to be engaged, the control button 32 is released, and spring 39 moves movable jaw 12 to a position engaging the object, jaw 11 being firmly against the object. When the wrench handle 18 is rotated in the direction indicated by arrow 55, the pressure of the object between the jaws against movable jaw 12 overcomes the compressive force of spring 47 and brings teeth 21 into engagement with teeth 27 and teeth 22 into engagement with teeth 28. These engagements prevent outward movement of movable jaw 12 while the wrench is in use. Upon discontinuation of wrench handle force in the direction of arrow 55, compression spring 47 releases the tooth engagements so that movable jaw 12 is again free to move. The wrench may then be slipped from the object, by depression of button 32 if necessary, and the wrench returns to its initial situation with jaw 12 in position 12*a*.

The size and spacing of the teeth determine the degrees of spacing of adjacent positions of movable jaw 12. In other words, if the teeth are of large size, then there will be fewer settings of movable jaw 12 and the settings will be farther apart. If the teeth are finer and more closely spaced, then movable jaw 12 will have many close-together settings.

The teeth may take different forms than those shown. Either or both sides of the teeth may be perpendicular to the support surface, for example, and the teeth may be deeper or more shallow than shown.

While a preferred embodiment of the invention has been described and shown in the drawings, many modifications thereof may be made by a person skilled in the art without departing from the spirit of the invention, and it is intended to protect by Letters Patent all forms of the invention falling within the scope of the following claims.

I claim:

1. Wrench, comprising body means having a fixed jaw having an inwardly facing face at one end, a movable jaw on said body means having a face parallely facing said face of said fixed jaw, said movable jaw having an angular outer side parallely disposed and freely movable along an angular support surface of said body means, said angular outer side of said movable jaw and said angular support surface having mutually releasably engageable tooth formations therealong, first spring means engaging said body means and said movable jaw and biasing said movable jaw toward said fixed jaw, second spring means engaging said body means and said movable jaw and biasing said movable jaw away from said angular support surface whereby said tooth formations are maintained disengaged, said movable jaw including control means for moving said movable jaw away from said fixed jaw against the pressure of said first spring means whereby said jaws may be disposed at opposite sides of an object, said first spring means closing said movable jaw against said object upon release of said control means, rotation of said body means in a direction whereby said object forces said movable jaw against said support surface to overcome the bias of said second spring means causing engagement of said tooth formations whereby said movable jaw becomes fixed against movement away from said fixed jaw whereby said wrench is fixedly engaged with said object.

2. The combination of claim 1, said body means including elongate handle means extending substantially parallely away from said faces of said fixed and movable jaws.

3. The combination of claim 1, said angular outer side of said movable jaw and said angular support surface each being at an angle of approximately 45° to said faces of said fixed and movable jaws.

4. The combination of claim 3, said body means including elongate handle means extending substantially parallely away from said faces of said fixed and movable jaws.

5. The combination of claim 1, said movable jaw having an elongate flange along said angular outer side thereof and having plural equally spaced transverse teeth along said outer side at opposite sides of said flange, said angular support surface having an elongate recess therealong to receive said flange and having plural equally spaced transverse teeth at opposite sides of said recess, said control means comprising a rod disposed through a bore through said body mean aligned with said recess and fixed at its inner end to said movable jaw whereby said movable jaw is moved away from said fixed jaw when the outer end of said rod is depressed, said first spring means comprising a helical compression spring disposed about said rod and compressively engaged between shoulders around said rod and said bore.

6. The combination of claim 5, said second spring means being disposed within a bore through said body means transverse to said angular support surface, said second spring means comprising a helical compression spring compressively disposed between said flange and a plug removably fixed in said last-named bore.

* * * * *